US011071997B2

(12) United States Patent
Schären et al.

(10) Patent No.: US 11,071,997 B2
(45) Date of Patent: Jul. 27, 2021

(54) DEVICE FOR APPLYING A FLOWABLE SUBSTANCE TO A SUBSTRATE

(71) Applicant: Robatech AG, Muri (CH)

(72) Inventors: Micha Schären, Frick (CH); Claudio Hofer, Cham (CH); Thomas Burger, Zug (CH)

(73) Assignee: ROBATECH AG, Muri (CH)

( * ) Notice: Subject to any disclaimer, the term of this patent is extended or adjusted under 35 U.S.C. 154(b) by 94 days.

(21) Appl. No.: 16/355,831

(22) Filed: Mar. 17, 2019

(65) Prior Publication Data

US 2019/0299241 A1 Oct. 3, 2019

(30) Foreign Application Priority Data

Mar. 27, 2018 (EP) ..... 18164294

(51) Int. Cl.
*B05C 5/02* (2006.01)
*B42C 9/00* (2006.01)
*B05C 11/10* (2006.01)

(52) U.S. Cl.
CPC ..... *B05C 5/0266* (2013.01); *B05C 5/0204* (2013.01); *B05C 5/0262* (2013.01); *B42C 9/0006* (2013.01); *B05C 5/0258* (2013.01); *B05C 11/1002* (2013.01)

(58) Field of Classification Search
CPC ... B05C 5/0266; B05C 5/0204; B05C 5/0262; B05C 5/0258; B05C 11/1002; B05C 11/1031; B42C 9/0006
USPC ..... 118/410, 429; 412/37; 156/578
See application file for complete search history.

(56) References Cited

U.S. PATENT DOCUMENTS

| | | | |
|---|---|---|---|
| 2001/0042507 | A1 | 11/2001 | Rothen |
| 2007/0224360 | A1 | 9/2007 | Fujihara et al. |
| 2012/0204789 | A1 | 8/2012 | Fujihara et al. |
| 2014/0017038 | A1 | 1/2014 | Knoefel et al. |

FOREIGN PATENT DOCUMENTS

| | | | |
|---|---|---|---|
| DE | 100 23 895 | A1 | 11/2001 |
| DE | 103 20 515 | A1 | 11/2004 |
| EP | 0 589 987 | A1 | 11/1996 |
| EP | 2 684 702 | A2 | 1/2014 |
| EP | 2 629 983 | B1 | 2/2015 |
| EP | 2886200 | * | 6/2015 |

* cited by examiner

*Primary Examiner* — Laura Edwards
(74) *Attorney, Agent, or Firm* — Christopher C. Dremann, P.C.; Christopher C. Dremann

(57) ABSTRACT

A device for applying a flowable substance to at least one substrate includes an applicator nozzle in the form of a slotted nozzle which has a stationary nozzle body with an inlet opening, a flow duct, and a nozzle slot, wherein the flowable substance is delivered through the applicator nozzle and passes from the inlet opening into the flow duct and from there to the nozzle slot, and is discharged through an outlet opening of the nozzle slot that is arranged in an outer region of the nozzle body, wherein the applicator nozzle further has a slide valve movable relative to the nozzle body in the longitudinal extent of the outlet opening and contacts the outer region of the nozzle body for modifying the covering of the outlet opening. The longitudinal extent of the flow duct is at least as great as the longitudinal extent of the nozzle slot.

17 Claims, 15 Drawing Sheets

DEVICE FOR APPLYING A FLOWABLE SUBSTANCE TO A SUBSTRATE

FIELD OF THE INVENTION

The invention relates to a device for applying a flowable substance, in particular a flowable adhesive, to at least one substrate, having an applicator nozzle in the form of a slotted nozzle which has a stationary nozzle body with an inlet opening, a flow duct, and a nozzle slot, wherein, when the flowable substance is delivered through the applicator nozzle, the flowable substance passes from the inlet opening into the flow duct and from there to the nozzle slot, and is discharged through an outlet opening of the nozzle slot, wherein the applicator nozzle moreover has a slide valve which can be moved relative to the nozzle body in the longitudinal extent of the outlet opening, over the latter, and contacts the outer region, for modifying the covering of the outlet opening.

With reference to an orthogonal system having the coordinates X, Y, and Z, a cross-sectional area of the flow duct extends in the direction Y, wherein the cross-sectional area is defined by a plane in the direction X-Z, a width of the nozzle slot extends in the direction Y, wherein the width is defined in the direction X, and a depth of the nozzle slot extends in the direction Y, wherein the depth is defined in the direction Z.

BACKGROUND AND RELATED ART

Devices of the aforementioned type are used in different ways. The main field of application is considered to be the applying of flowable adhesives by means of the devices. A further essential field of application is, in contrast to adhesive technology, coating technology and hence the applying of flowable substances for the purpose of coating substrates by means of the device.

In the production of adhesive-bound printed matter such as catalogs, magazines, brochures, paperback books, or similar products, printed sheets are gathered together to form loose book blocks and are then processed in an adhesive binder essentially on their spines, and then adhesive is applied to the book block spines and/or to the inside of the spine of a cover which is joined to the book block and then pressed against the latter. The book blocks are here each clamped in a transport clamp, circulating in a guided fashion, of the adhesive binder with the spines projecting downward.

When producing books using an adhesive binding method, it is known to apply the adhesive by means of applicator nozzles. The adhesive here is in particular a dispersion adhesive, a hot melt adhesive, or a combination of dispersion and hot melt adhesives. In recent years, a polyurethane adhesive, abbreviated to PUR, has hereby proved to be a hot melt adhesive which has a particularly high resistance to the sheets being pulled out and provides particularly advantageous results for the book block in terms of lay-flat behavior. This adhesive can also advantageously be used for poorer-quality paper, for example for coated papers in which the proportion of coating elements is greater than the proportion of fibers required for strength, and which are also harder to roughen in order to expose the fibers for applying the adhesive.

So-called slotted nozzle applicator devices are preferably used for processing reactive adhesives, for example polyurethanes which chemically react with moisture in the environment. The adhesive is usually liquefied in a sealed pre-melter filled with a dry gas and fed to an applicator head of the applicator nozzle in the form of a slotted nozzle, via an adhesive feed line, by means of a positive-displacement pump and transferred by said applicator head to the book block spine or the cover. The amount of adhesive that needs to be conveyed per unit time depends on the speed at which the book block is conveyed, the thickness of the book block, and the thickness to be obtained of the adhesive film to be applied to the book block spine or the cover. Based on these parameters, a control device calculates the required speed of the pump or the amount of adhesive to be delivered by the pump. The feed of adhesive to the slotted nozzle needs to be interrupted in the region between successive book blocks.

A device which has the features of a device according to the invention is known from DE 103 20 515 A1. The device serves to apply a flowable adhesive. A reduced pressure is thereby created in an adhesive-filled chamber such that a bellows which is part of a chamber wall is pulled outward by means of an actuating device. Adhesive is sucked into the chamber by the reduced pressure. An elevated pressure is then created in the chamber by the bellows being pushed into the chamber by the actuating device. The elevated pressure causes adhesive from the chamber to be pressed through a surface applicator nozzle and thus applied. The nozzle opening of the surface applicator nozzle is designed as a slot opening. Relative to its outlet cross-section, the slot has a maximum length which corresponds to the maximum width of the book spine to be processed. In the case of narrower book spines, the nozzle slot is closed in sealing fashion by a slide valve corresponding to the desired width of the book spine. In this device, virtually no or little adhesive flows through part regions, in particular part regions of the bellows. The adhesive can age and completely or partially harden in these spaces. Apart from this, the design of the device with the bellows is structurally complex and prone to faults.

When one or more digital printing presses are connected inline with an adhesive binding line, the profitability can be significantly increased if different batches of varying formats can be manufactured without it being necessary to interrupt production. It also needs to be ensured that the first product of a new batch is saleable. So-called waste set-up sheets are no longer acceptable.

A device for applying adhesive to a book block spine by means of an applicator nozzle is known from EP 2 684 702 A2. A line connects the applicator nozzle to an adhesive supply system. An outlet opening of a nozzle slot of the applicator nozzle can be modified and can be adapted to the thickness of a book block to be processed. For this purpose, the applicator nozzle has a first chamber for providing adhesive, adjoining the outlet opening, and a second chamber arranged between the outlet opening and the adhesive supply system. A first slide valve in the region of the first chamber serves to modify the width of the first chamber and a second slide valve in the region of the second chamber serves to modify the volume of the second chamber. The second chamber thus represents a reservoir with a modifiable volume and which can be used to hold excess adhesive when switching from a book block of larger thickness to a less thick book block, or to dispense additional adhesive when switching from a book block of smaller thickness to a thicker book block. It is consequently ensured that, when modifying the outlet opening of the nozzle slot, excess adhesive does not cause a bead of adhesive which could either clog up the applicator nozzle or contaminate the book block. A disadvantage of this device is that there are regions of the applicator nozzle through which there is virtually no or little flow such that in particular PUR adhesive can age and completely or partially harden in these cavities. Apart from that, the structural design of this device is extremely complex.

An applicator nozzle for creating a flat extrudate of liquid material, in which a flow duct formed in the nozzle body is designed in the shape of a clothes hanger, is known from EP 0 589 987 A1. An inlet opening in the flow duct is arranged in a central region of the flow duct.

OBJECTS AND SUMMARY OF THE INVENTION

An object of the present invention is to develop a device that has a particularly simple structural design, a uniform outlet of the flowable substance through the outlet opening is ensured at different covering positions of the slide valve, and when the position of the covering of the outlet opening is modified no flowable substance emerges from the outlet opening, and moreover no cavities are formed in the nozzle body which are not or only partially filled with the flowable substance.

This and other objects are achieved by a device according to the invention.

In the device according to the invention, it is provided that the longitudinal extent of the flow duct is at least as great as the longitudinal extent of the nozzle slot. The inlet opening is hereby in fluid communication with the flow duct in the region of one end of the flow duct. The other end of the flow duct ends in the region of one end of the nozzle slot. The outlet opening can be covered by means of the slide valve, starting from the other end of the nozzle slot. The cross-sectional area of the flow duct hereby continuously decreases in the direction Y from one end of the flow duct to the other end of the flow duct, and moreover the width of the nozzle slot is constant over its progression in the direction Y or the width of the nozzle slot increases continuously over its progression in the direction Y from the other end to the first end, and moreover the depth of the nozzle slot is constant over its progression in the direction Y or the depth of the nozzle slot decreases continuously over its progression in the direction Y from the other end to the first end, wherein the width of the nozzle slot and the depth of the nozzle slot are not constant at the same time.

By virtue of this design of the device, irrespective of the position in which the slide valve is situated and hence irrespective of to what extent the outlet opening is covered, the flowable substance is always conveyed over the whole length of the flow duct and hence from the inlet opening to that end of the flow duct which is remote from the inlet opening. The cross-sectional area of the flow duct over its length and the cross-sectional area of the nozzle slot over its length are dimensioned such that the flowable substance is discharged so that it is uniformly distributed over the length of the nozzle slot, irrespective of the position in which the slide valve is situated. As a consequence, when the slide valve is adjusted, flowable substance situated inside the nozzle slot is not conveyed out of the nozzle slot because the slide valve exerts no influence on the flowable substance situated in the nozzle slot. By virtue of the design of the flow duct and the nozzle slot, the flowable substance is discharged largely constantly over that length of the outlet opening of the nozzle slot which is not covered by the slide valve.

For manufacturing reasons, the nozzle slot preferably has a cross-sectional area over its length which is identical in terms of its shape.

It is considered particularly advantageous if the flow duct and/or the nozzle slot have an unmodifiable volume. The volume of the flow duct and the nozzle slot is thus not modified, irrespective of the respective position of the slide valve, and consequently no further inserts need to be provided within the nozzle body which would effect a modification of the volume. The structural design of the device is particularly simple because, with respect to the stationary nozzle body, all that is required is to provide the latter with the inlet opening, the flow duct, and the nozzle slot.

According to an embodiment of the invention, it is provided that an actuator for interrupting the flow of flowable substance into the flow duct is arranged upstream from the inlet opening. This actuator, which is in particular a valve which can be displaced into an open or closed position, is always situated in the open position when the flowable substance is discharged from the nozzle body, and hence when the flowable substance is applied to the substrate. The actuator is in particular in its closed position when the slide valve is displaced. If the slide valve is displaced, no flowable substance is thus conveyed through the inlet opening into the flow duct and the nozzle slot.

The flow duct preferably has, in the region of the nozzle slot, a cross-sectional area which changes essentially linearly over the local length of the flow duct, or a cross-sectional area which changes in a curve of single curvature, i.e. one with no point of inflection. This design takes into account to a particularly high degree the circumstance where the flowable substance is supplied in the region of one end of the flow duct and hence, owing to the discharging of the flowable substance through the nozzle slot, a greater volume of the flowable substance needs to be present upstream of the flow duct than downstream, and moreover there are friction losses when the substance is conveyed. This requirement can particularly advantageously be fulfilled by this change in the cross-sectional area of the flow duct in the region of the nozzle slot.

In particular, the cross-sectional area of the flow duct decreases toward the other end of the flow duct, i.e. that end which is remote from the inlet opening.

In particular, the cross-sectional area of the flow duct at the other end of the flow duct is no more than half as large as the cross-sectional area of the flow duct at the first end.

The shape of the changeable cross-sectional area of the flow duct is preferably identical. Such a design is particularly simple to produce structurally and enables optimum throughflow conditions in the flow duct.

It is in particular provided that the change in the cross-sectional area of the flow duct and/or the change in the width of the nozzle slot and/or the change in the depth of the nozzle slot in each case is non-linear over its length, in particular is a curve of single curvature.

The structural design of the nozzle body is particularly simple when it has a first nozzle body part and a second nozzle body part which are connected to each other and between which the flow duct and the nozzle slot are formed. The flow duct and the nozzle slot can thus be integrated particularly simply into one or the other nozzle body part or into both nozzle body parts such that the nozzle body is formed when the two nozzle body parts are connected. The nozzle body in particular has strip-shaped nozzle body parts. The nozzle body parts thus have an elongated form and are particularly well suited for forming the flow duct and the nozzle slot in the nozzle body.

It is considered to be particularly advantageous if the flow duct and/or the nozzle slot is or are formed exclusively by depressions in a nozzle body part. This considerably reduces the structural and production complexity of the nozzle body. In this respect, it is in particular provided that the cross-sectional area of the flow duct has the shape of a semi-circle. Such a semi-circular depression can be introduced into the relevant nozzle body part particularly simply.

It is in particular provided that the flow duct and the nozzle slot are formed in one nozzle body part, and the inlet opening and a feed line into the inlet opening are formed in the other nozzle body part. As a result, the functionalities are structurally separated, namely the functionality of the flow duct and the nozzle slot is associated with one nozzle body part and the functionality of the inlet opening and the feed line into the inlet opening are associated with the other nozzle body part. This facilitates not only the production of the nozzle body, but also the connection of the nozzle body to a feed line for the flowable substance.

According to another embodiment, it is provided that the nozzle slot has over its length a shape such that the width of the nozzle slot is constant between the flow duct and the outlet opening or tapers continuously from the flow duct to the outlet opening, and in particular tapers linearly. When there are identical pressure ratios in the flow duct over its length, relative to the length of the nozzle slot, a constant flow of the flowable substance through the outlet opening of the nozzle slot is achieved over the length of the nozzle slot.

It is in particular provided that the outlet opening and/or the nozzle slot, relative to its longitudinal extent, is or are arranged horizontally, in particular the outlet opening is arranged above the flow duct. This design or arrangement takes into account that the flowable substance, in the present case in particular a flowable adhesive, is discharged upward so that it can be applied to a substrate which is arranged above the nozzle body and conveyed over its outlet opening. A vertical arrangement instead of the described horizontal arrangement is completely possible.

The vertical arrangement described herein, hence the vertical orientation of the applicator nozzle, takes place in particular for so-called edge banding. This is used, for example, to produce sheet material in the wood-processing industry. Adhesive is here applied to the narrow edges of sheet material.

The outer region, facing the outlet opening, of the nozzle body in particular has a flat design and the slide valve has a flat section for contacting the nozzle body in this region, in particular for sealing contact with pretensioning.

The outlet opening of the applicator nozzle can preferably be completely covered by means of the slide valve, in particular can be covered in sealing fashion. In the event of a stoppage of the device for applying the flowable substance, in particular a PUR adhesive, the substance or the adhesive in the applicator nozzle is prevented from being able to react, in particular from being able to harden owing to the moisture in the surrounding air.

It is considered to be advantageous if the device has a feed guide which is provided with a bearing surface which is arranged at right angles to the longitudinal extent of the outlet opening, to the side of the outlet opening, and moreover the slide valve has, on a side facing the feed guide, a bearing surface which is arranged parallel to the bearing surface of the feed guide. An insertion region for the respective substrate is thus formed between the bearing surfaces of the feed guide and the slide valve, irrespective of the position of the slide valve. The substrate is hereby in particular a book block which is held in a clamping device and is contacted between the bearing surfaces of the feed guide and the slide valve, to the side of where it is guided.

The bearing surfaces in particular have face regions which form converging insertion faces for the substrate.

A preferred area of application of a device according to the invention is the application of adhesive to book spines. It is in particular intended that the device can be used as a component of an adhesive application device in connection with digital printing and downstream book production termed "book on demand". This means that the size of the print run can be as low as a single unit. It thus needs to be possible for the application width of the adhesive on the book spine to be adjusted during the period of time between two applications of adhesive to two successive book blocks such that the adhesive can be applied to two successive books of different thickness in such a way that the quality of the adhesive application is sufficient. It is completely possible for this application width to be only in the range of 2 to 5 mm.

In this connection, a closed adhesive system is used which takes into account the properties of reactively hardening hot melt adhesives such as PUR and minimizes the ingress of surrounding air and hence moisture and keeps the mechanical load on the adhesive low. In this respect, the slotted nozzle used is particularly advantageous. The slotted nozzle has an adjusting mechanism for adjusting the application width of adhesive on the respective book spines. After adjustment, there is no need to retract the slotted nozzle such that the quality of the adhesive application for the first book after adjustment is sufficient. The slide valve and its drive means are configured in such a way that, during adjustment, the position of the slide valve does not influence the volume of the adhesive inside the slotted nozzle. Thus no adhesive emerges during adjustment and no additional cavities are created which are not, or only partially, filled with adhesive. The slotted nozzle and the adjusting mechanism for the slide valve are configured in such a way that there are no moving parts which can become clogged up. It is possible to clean simply by virtue of the simple geometry of the adhesive-guiding parts. The volume inside the slotted nozzle is designed such that adhesive flows through all the cavities which are exposed to adhesive and there are no so-called dead spaces in which the adhesive can age or harden.

In addition to the aforementioned advantages and features, the device according to the invention is moreover characterized by a simple structure with few parts which come into contact with the adhesive. As a result, the disassembly, cleaning, and maintenance of the device are not complex. The uniform application of adhesive is constant over the whole thickness of the book block such that the quality of the application of the adhesive is at least sufficient. This uniformity remains unchanged over the whole adjustment range of the width of the application of adhesive. This uniformity likewise remains unchanged over a wide range of the viscosity of the adhesive.

Other advantages and features of the invention will be apparent from the following detailed description, the description of the drawings and the drawings themselves, wherein the individual features and combinations of the individual features are described and shown.

BRIEF DESCRIPTION OF THE DRAWING FIGURES

The invention is illustrated in the drawings with reference to exemplary embodiments in a schematic view, without being limited thereto.

DETAILED DESCRIPTION OF EXEMPLARY EMBODIMENTS

Figure 1:
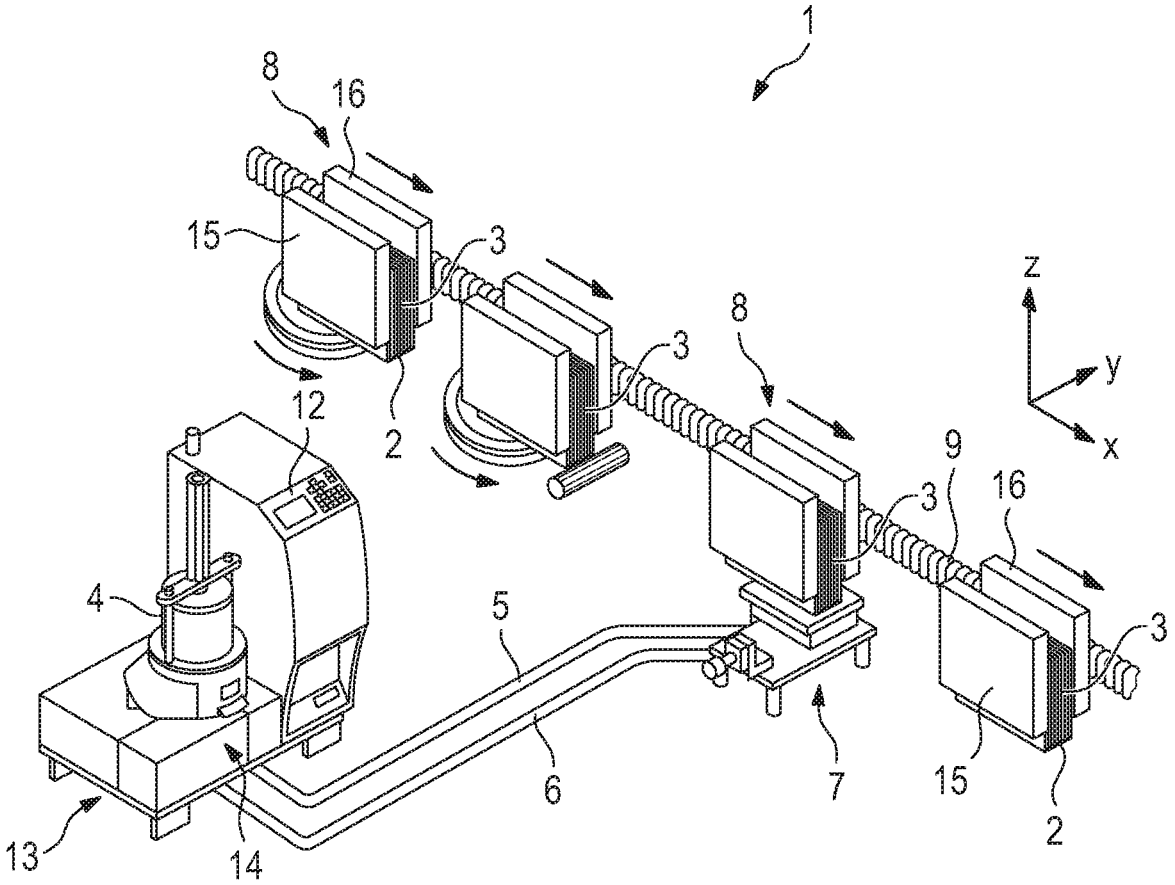
FIG. 1 shows an adhesive binder, shown for areas which are relevant in terms of a device according to the invention.

FIG. 1 illustrates the installed situation of an adhesive binder 1 for intermittently applying a flowable adhesive to substrates, in the present case to book spines 2 of book blocks 3. The adhesive is, for example, polyurethane. This hot melt adhesive has a particularly high resistance to the sheets being pulled out, and moreover an optimum lay-flat behavior for book blocks 3.

Figure 2:
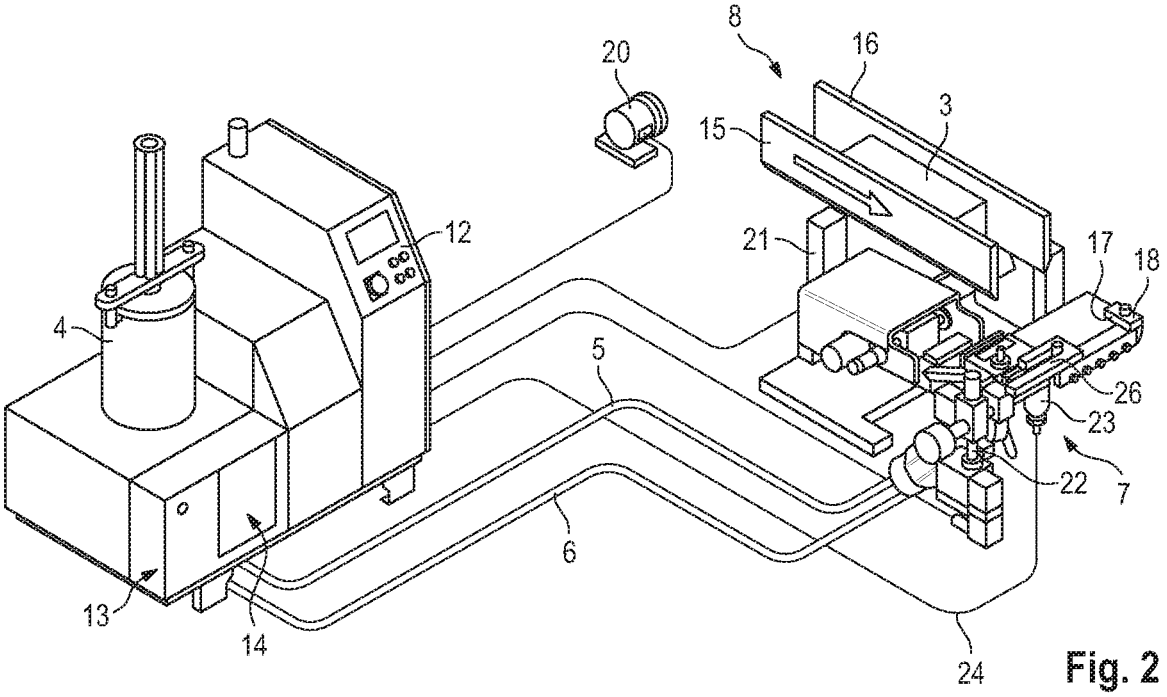
FIG. 2 shows the adhesive binder according to the view in FIG. 1, in a detailed view in terms of part regions.

With reference to the view in FIGS. 1 and 2, with respect to the device 1, a pre-melter 4, a feed line 5 for the heated adhesive, a return line 6 for the heated adhesive, and an application station 7 for the heated adhesive are shown. The book blocks 3 are clamped in transport clamps 8 and are moved by a conveying device 9 in a direction of movement which corresponds to the illustrated coordinates X of an orthogonal system, over the application station 7, and to be precise an applicator nozzle 10 of the application station 7. The other coordinates Y and Z are illustrated. A rectangular outlet cross-section of the applicator nozzle 10, viewed in the plan view, in an opposite direction to the coordinate Z, has an adjustable longitudinal extent in the direction Y, and a constant widthwise extent in the direction X. The variable longitudinal extent of the outlet cross-section is matched to the respective width of the book block 3, wherein this width extends in the direction Y, and the applied length of the adhesive on the book spine 2 of the book block 3 results from the conveying movement of the respective book block 3 in the direction X when the applicator nozzle 10 is open. Depending on the conveying speed of the book spine 2 relative to the open applicator nozzle 10 and on the mass flow rate of the adhesive through the outlet cross-section of the applicator nozzle 10, a defined application thickness in the direction Z results on the book spines 2 (see in particular the view in FIG. 3).

The adhesive is applied uniformly to the book spines 2 with the aid of a control device 12, an electric drive means 13, and a pump 14, which can be driven by means of the drive means 13, for conveying the flowable adhesive. The speed of the drive means 13 can be regulated. The pump 14 is a geared pump. The drive means 13 and the pump 14 are arranged underneath the pre-melter 4. The drive means 13 is connected to the pump 14 via a clutch.

The respective transport clamp 8 has a front jaw 15 in the form of a plate and a rear jaw 16 also in the form of a plate. The jaws 15, 16 of the respective transport clamp 8 are moved synchronously in the direction X. The respective rear jaw 16 cannot move in the direction Y. Only the front jaw 15 can move in the direction Y and in the opposite direction such that the distance between the two jaws 15, 16 can be modified in order to clamp the book blocks 3 between the jaws 15, 16. The respective rear jaw 16 forms, on the side facing the front jaw 15, a plane spanned by the coordinates X and Z which essentially lies on the same plane, apart from slight deviations, as a bearing surface 17 of a fixed feed guide 18 of the application station 7. This feed guide 18 forms a guide for the book block 3 on an applicator head 19 of the application station 7.

Actively connected to the control device 12 are a sensor 20 for detecting the transport speed of the book block 3 in the direction X, a sensor 21 for detecting the beginning and end of the respective book block 3, relative to the direction X, and an actuator 22, in the form of a valve, for feeding the flowable adhesive to the applicator head 19 and, if required, a pressure sensor 23 via a connection line 24. The flowable adhesive is fed from the pre-melter 4 via the feed line 5 by positive displacement from the pump 14, which is driven by means of the drive means 13, and controlled via the control device 12. Adhesive conveyed by the pump 14 is returned to the pre-melter 4 via the return line 6 during periods when no adhesive is being applied.

Figure 3:
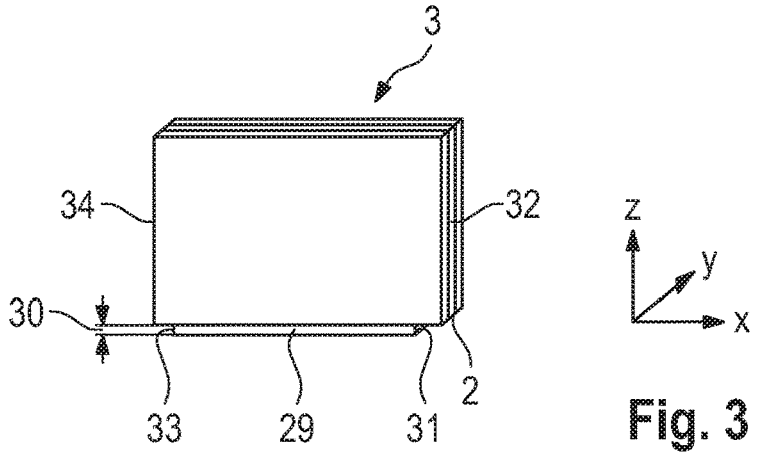
FIG. 3 shows a book spine with applied adhesive.
Figure 4:
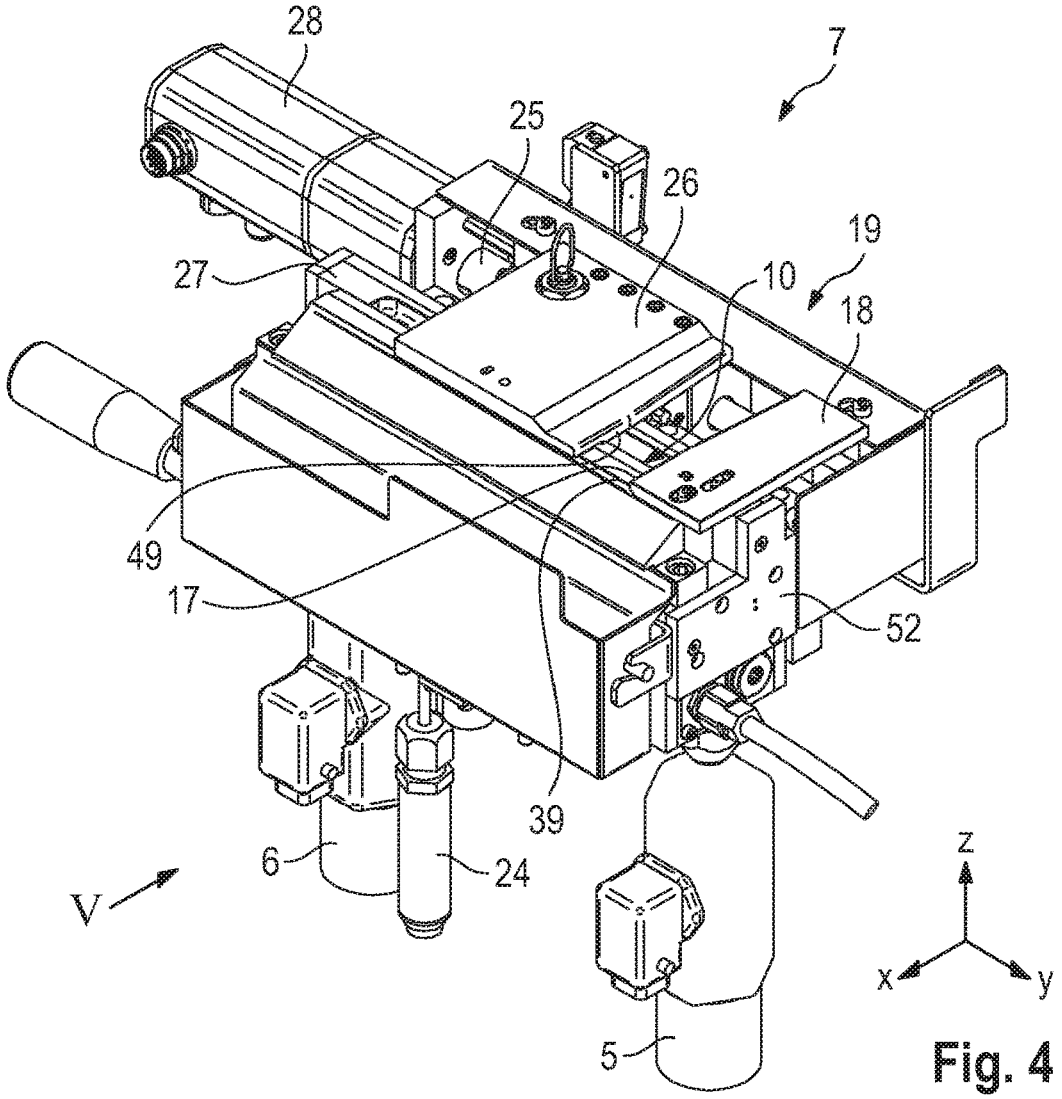
FIG. 4 shows an application station of the adhesive binder, illustrated in a three-dimensional view.
Figure 5:
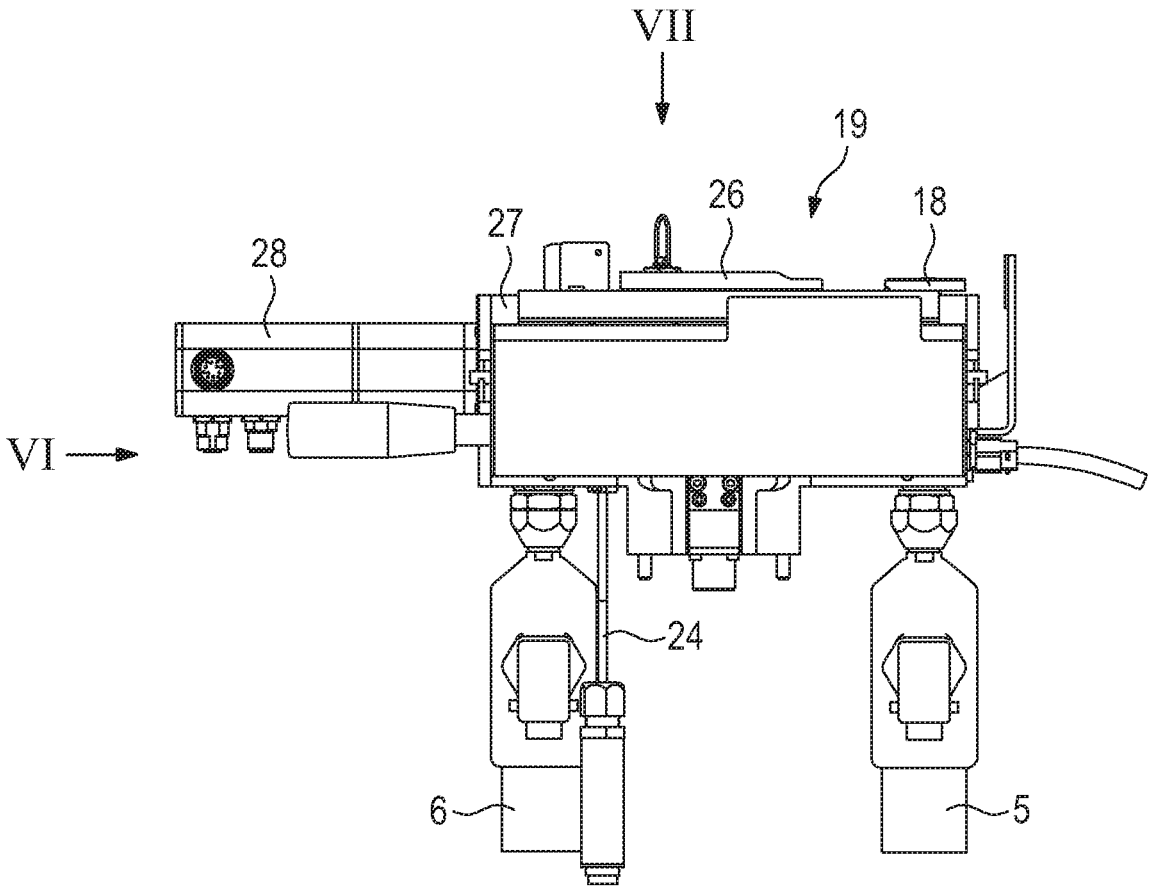
FIG. 5 shows the application station in a view V according to FIG. 4.
Figure 6:
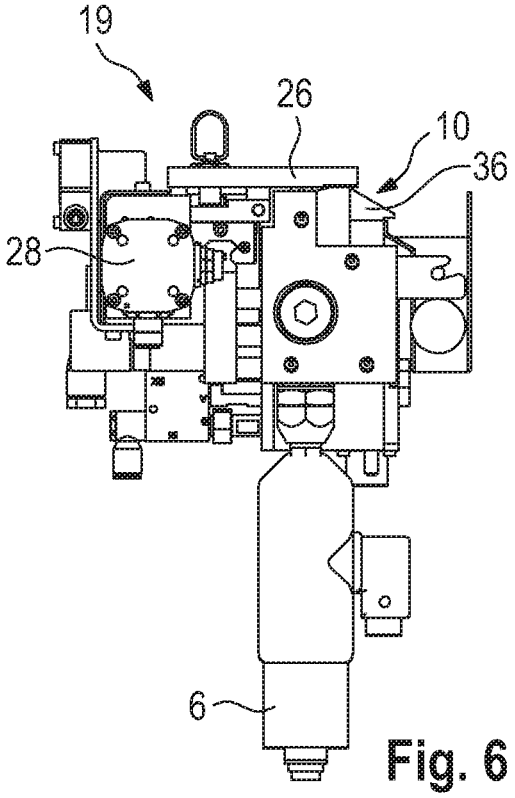
FIG. 6 shows the application station in a view VI according to FIG. 5.
Figure 7:
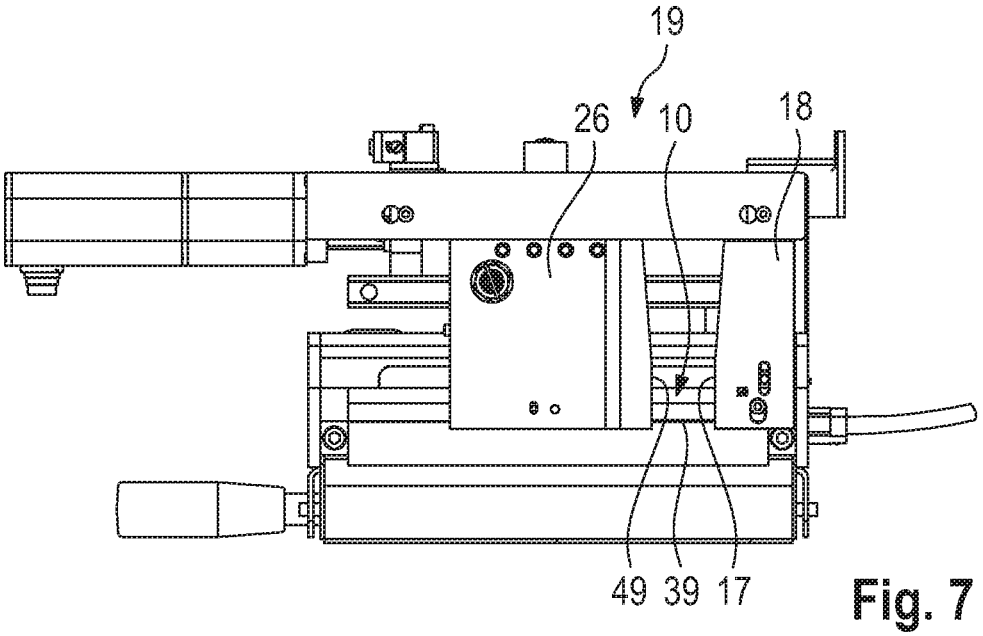
FIG. 7 shows the application station in a view VII according to FIG. 5.
Figure 8:
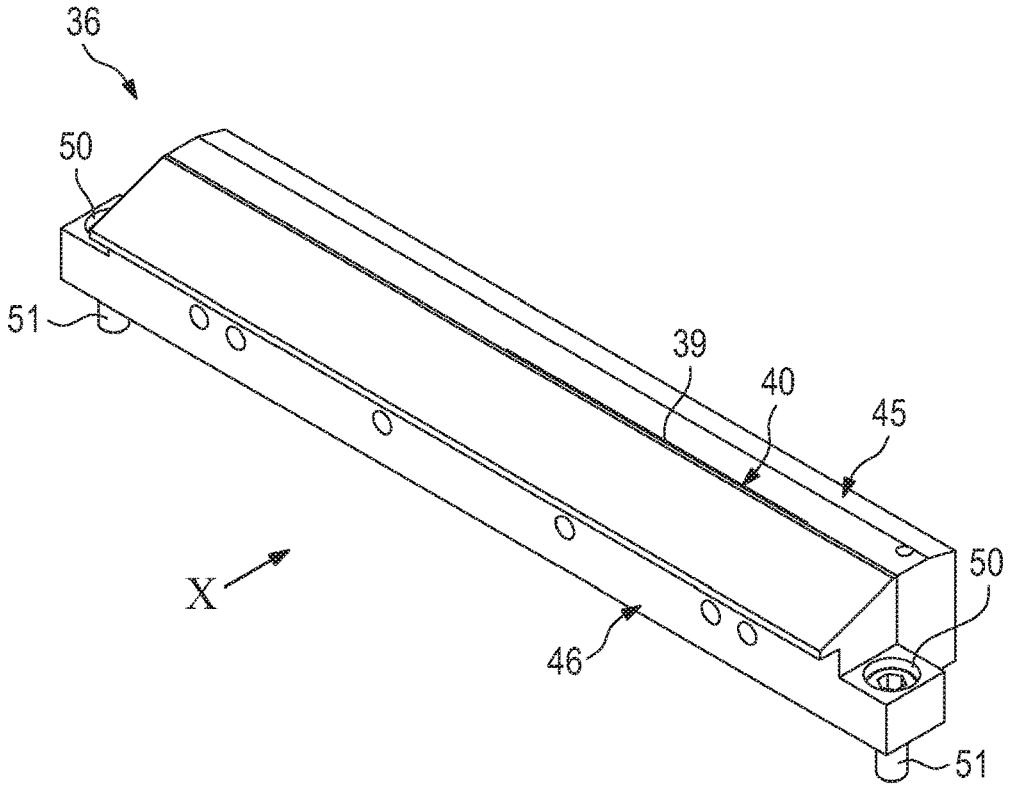
FIG. 8 shows the applicator nozzle used in the application station, shown for a first exemplary embodiment, illustrated with no slide valve, in a three-dimensional view.
Figure 9:
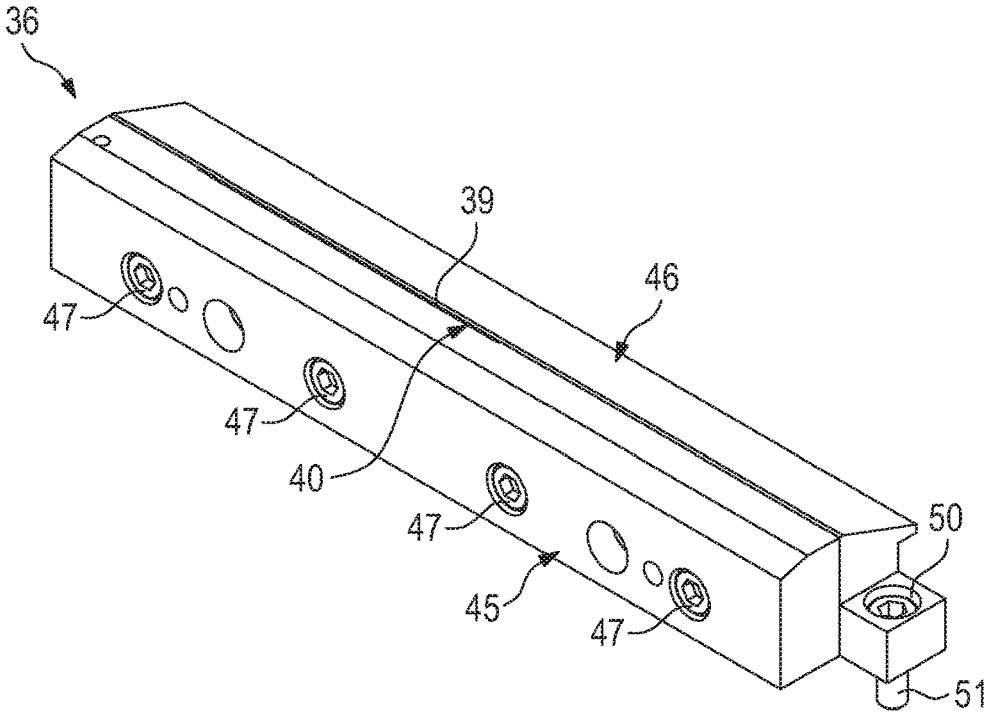
FIG. 9 shows the arrangement shown in FIG. 8 in a three-dimensional view, viewed from a different direction.
Figure 10:
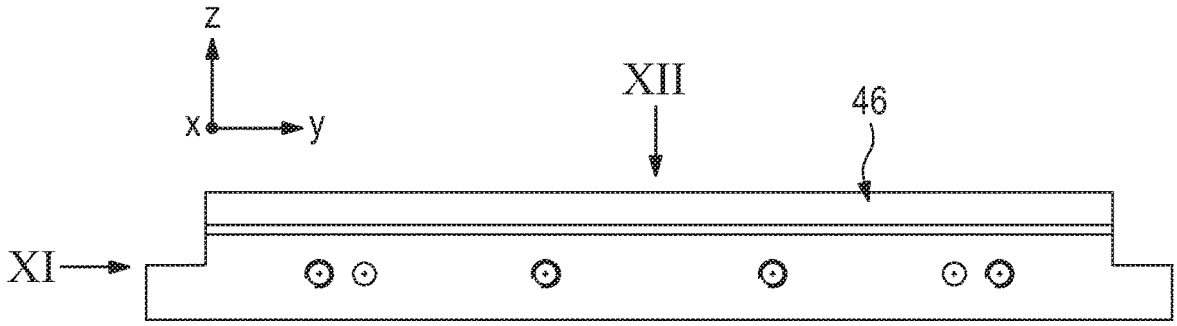
FIG. 10 shows the arrangement according to FIG. 8 in a view X according to FIG. 8.
Figure 11:
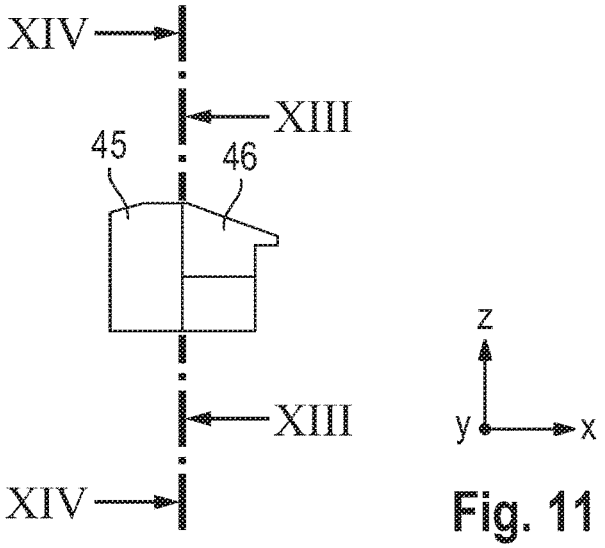
FIG. 11 shows a view XI according to FIG. 10.
Figure 12:
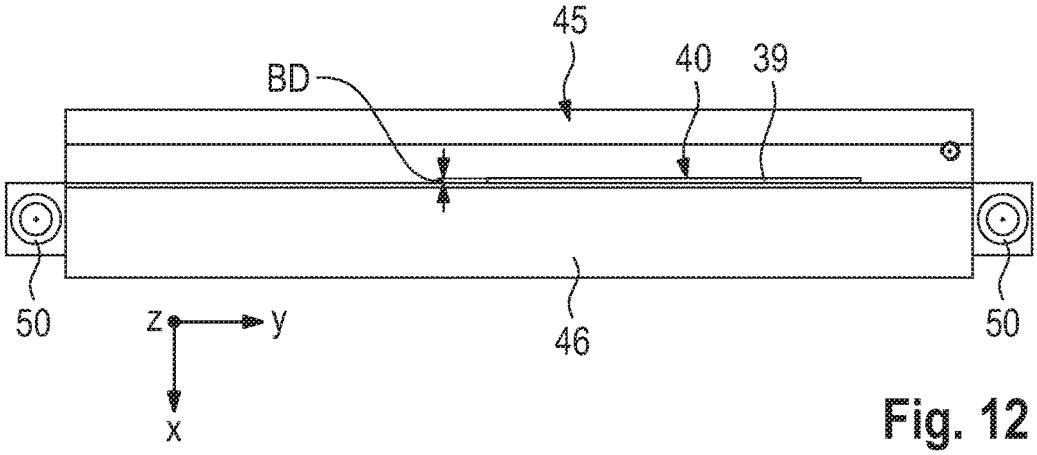
FIG. 12 shows a view XII according to FIG. 10.
Figure 13:
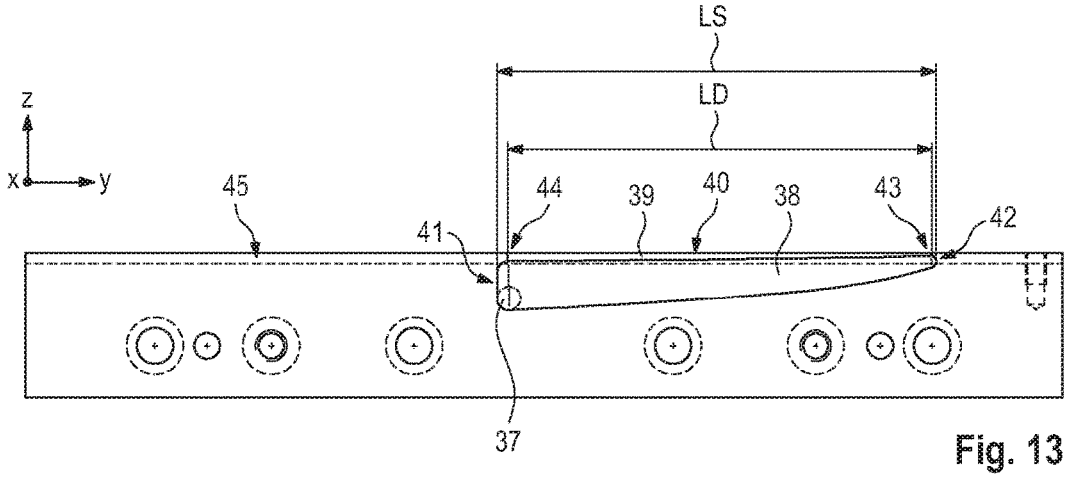
FIG. 13 shows a section along the line XIII-XIII in FIG. 11.
Figure 14:
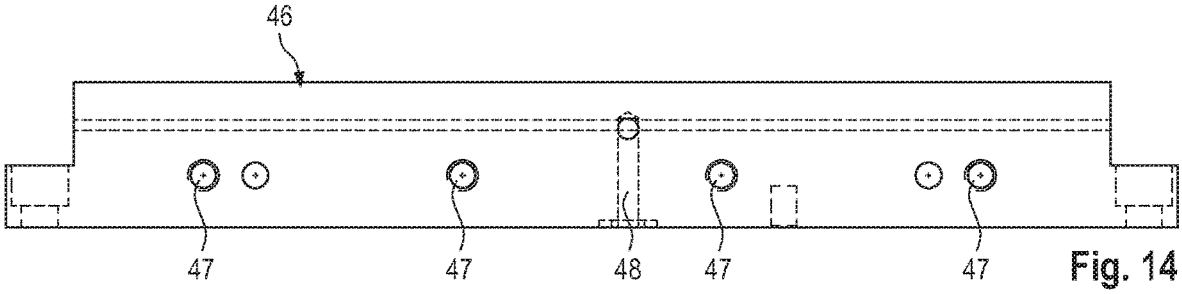
FIG. 14 shows a section along the line XIV-XIV in FIG. 11.
Figure 15:
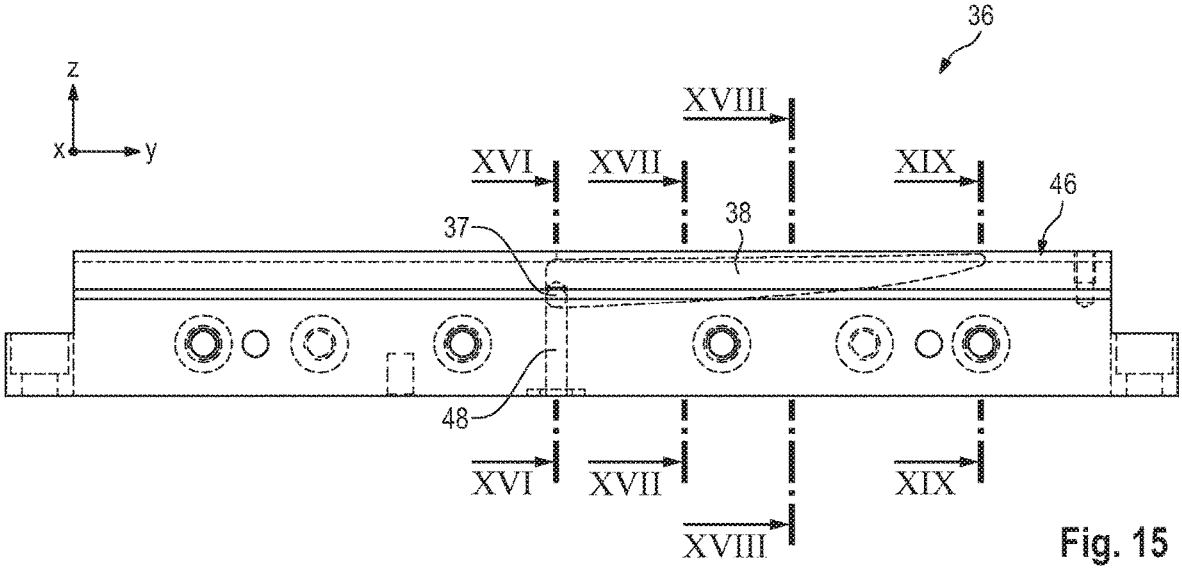
FIG. 15 shows the arrangement in the view according to FIG. 10, with internal regions additionally illustrated by means of dot-dashed lines.
Figure 16:
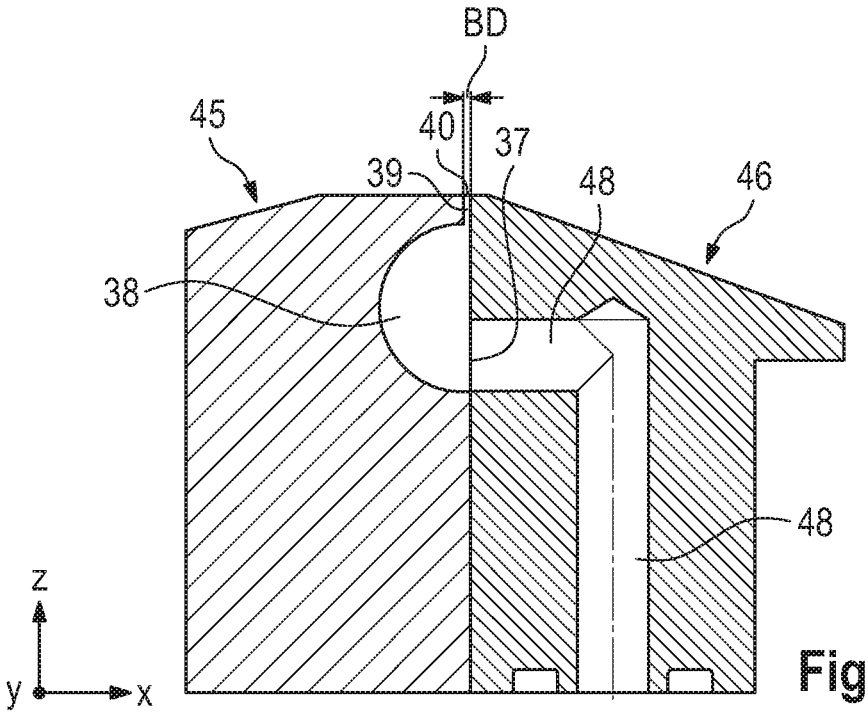
FIG. 16 shows a section along the line XVI-XVI in FIG. 15.
Figure 17:
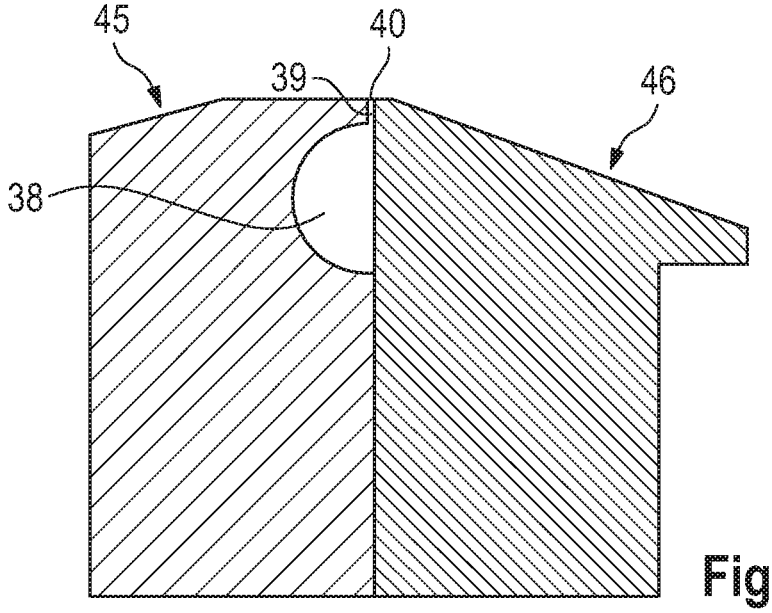
FIG. 17 shows a section along the line XVII-XVII in FIG. 15.
Figure 18:
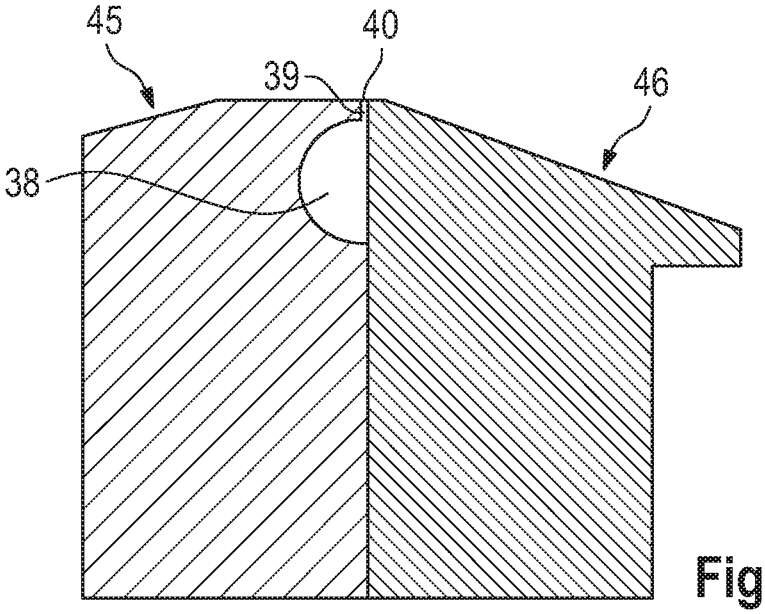
FIG. 18 shows a section along the line XVIII-XVIII in FIG. 15.
Figure 19:
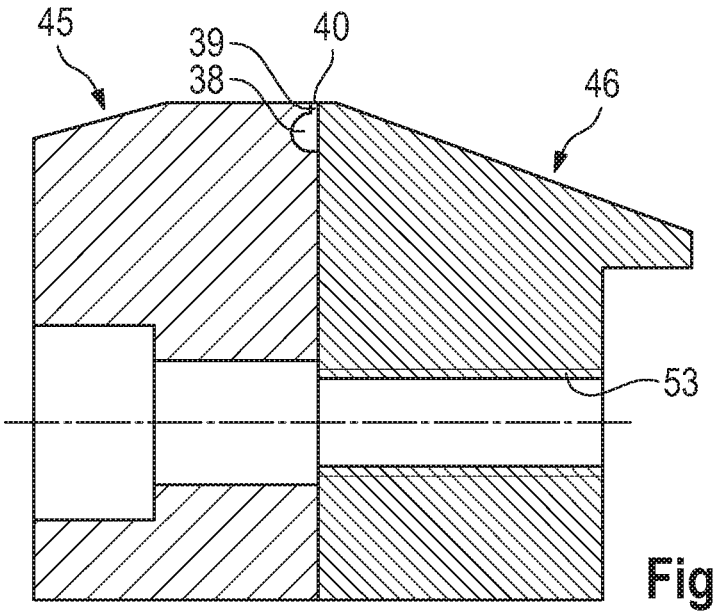
FIG. 19 shows a section along the line XIX-XIX in FIG. 15.
Figure 20:
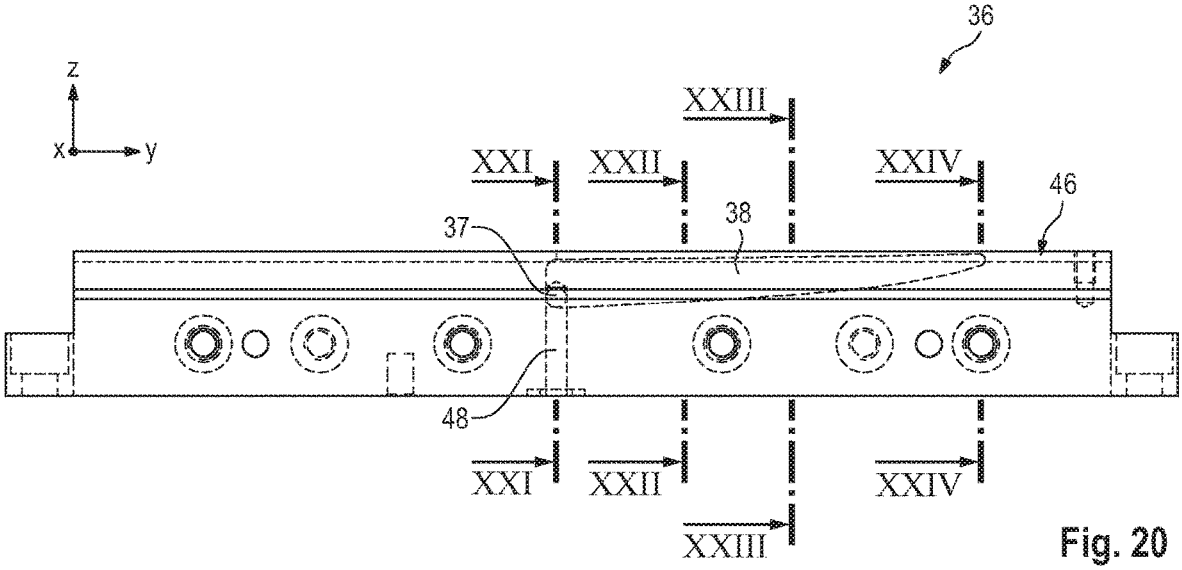
FIG. 20 shows the applicator nozzle used in the application station, shown for a second exemplary embodiment, illustrated without a slide valve, in a view according to FIG. 15.
Figure 21:
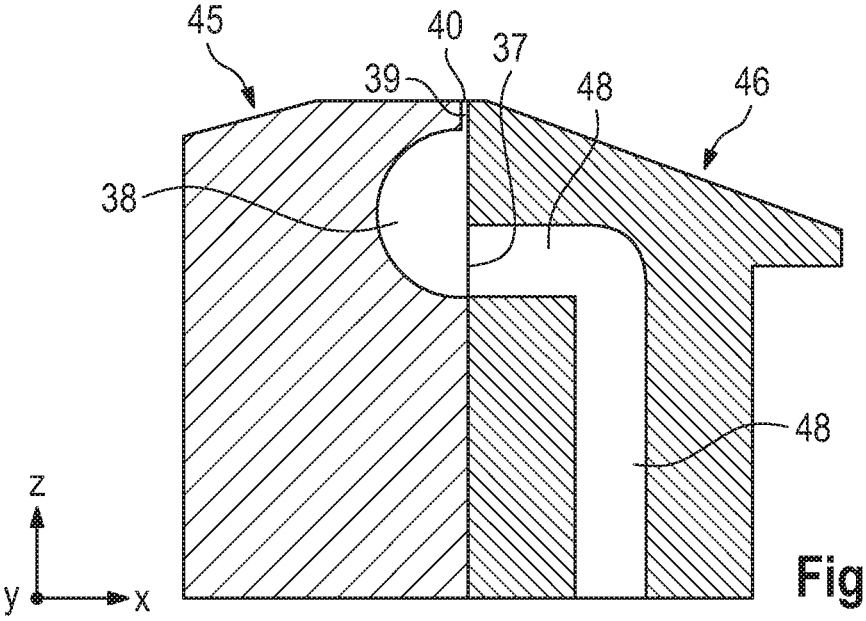
FIG. 21 shows a section along the line XXI-XXI in FIG. 20.
Figure 22:
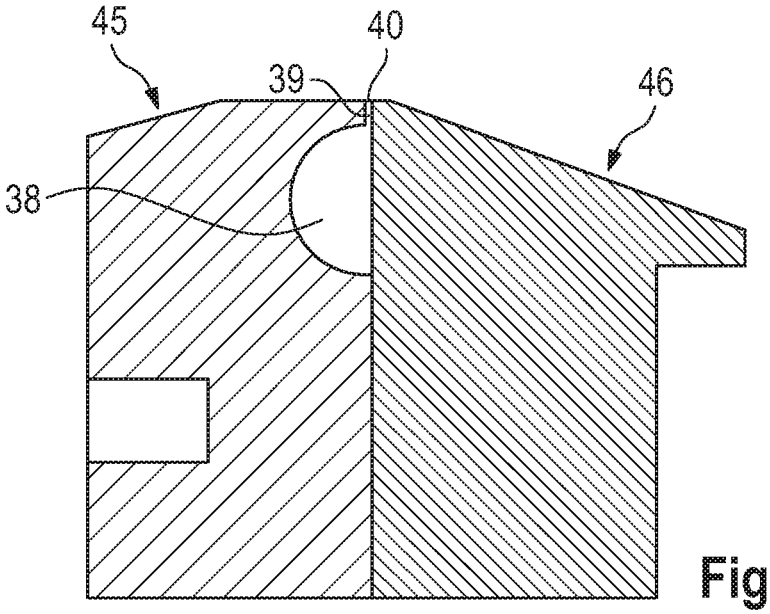
FIG. 22 shows a section along the line XXI I-XXII in FIG. 20.
Figure 23:
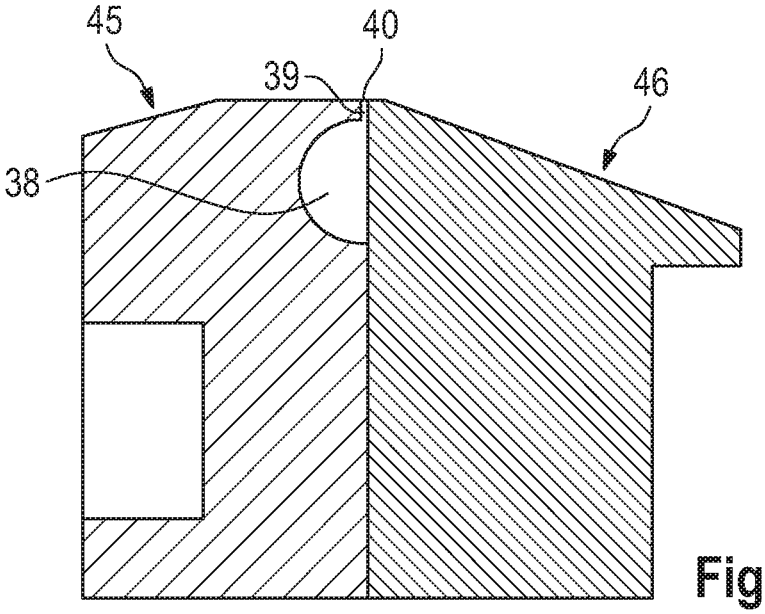
FIG. 23 shows a section along the line XXIII-XXIII in FIG. 20.
Figure 24:
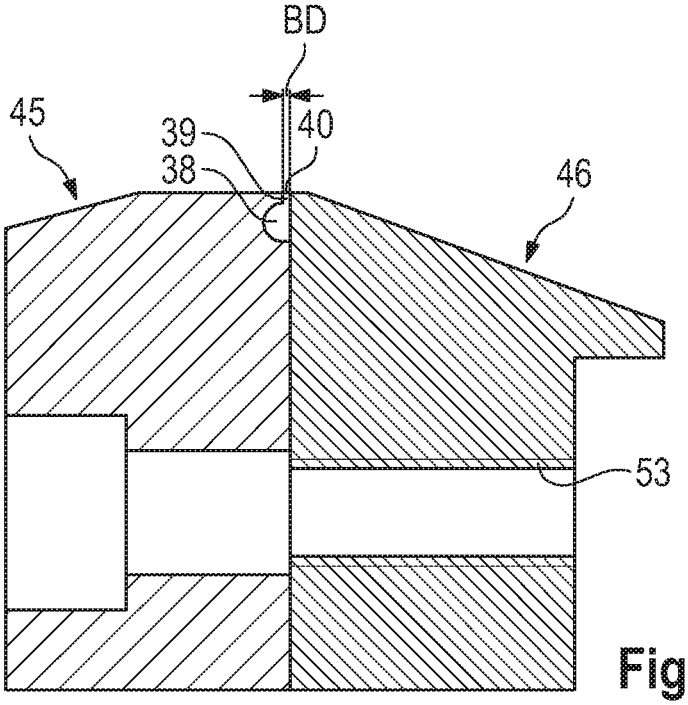
FIG. 24 shows a section along the line XXIV-XXIV in FIG. 20.

FIG. 3 shows a schematic diagram of a book block 3 and its most important dimensions, and moreover an application of adhesive 29. The adhesive is applied to the book spine 2. The application thickness 30 of adhesive can be set within a range of 0.05 to 4 mm. The application thickness preferably lies within the range of 0.3 to 0.6 mm for PUR. The distance from the beginning of the application 31 to the front side 32 of the book block 3 and the distance from the end of the application 33 to the rear side 34 of the book block 3 can be set to be between −5 and 100 mm. These values preferably lie between 0 and 15 mm. The application width, i.e. the dimension in the direction Y, corresponds essentially to the book block thickness and lies within the range of 1 to 80 mm. The maximum production rate of the book block 3 to be expected can be set to be between 1000 per hour and approximately 6000 per hour. The system described can, however, also be used for significantly higher production rates. The change in the application width is then restricted by adjusting the slide valve 26 between two successive book blocks.

FIGS. 4 to 7 illustrate details of the applicator head 19 with an adjusting mechanism 25 for adjusting the outlet cross-section of the applicator nozzle 10. A cover, which takes the form of a slide valve 26, covers the outlet cross-section to a greater or lesser degree. The slide valve 26 can be displaced in the direction Y and in the opposite direction by means of the adjusting mechanism 25. The respective book block 3 is moved linearly in the direction X over the applicator nozzle 10 in the form of a slotted nozzle. The flowable adhesive is thus transferred onto the book spine 2 via the outlet cross-section. The respective slide valve 26 is guided, with as little play as possible, by a linear guide 27 and is activated via the adjusting mechanism 25, which is driven by a drive means 28, and is in each case adjusted such that the length Y of the outlet cross-section corresponds essentially to the book block thickness.

The specific structure of the applicator nozzle 10 in the form of a slotted nozzle is shown in FIGS. 8 to 19 for a first exemplary embodiment.

The applicator nozzle 10 has a stationary nozzle body 36. The latter has an inlet opening 37, a flow duct 38, and a nozzle slot 39. When the adhesive is conveyed through the applicator nozzle 10, the flowable adhesive passes from the inlet opening 37 into the flow duct 38 and from there to the nozzle slot 39. The flowable adhesive is discharged through an outlet opening 40 of the nozzle slot, which opening defines the outlet cross-section. The outlet opening 40 is arranged in an outer region of the nozzle body 36. The applicator nozzle 10 moreover has the slide valve 26, which is in the form of a plate, and can be moved relative to the nozzle body 36 in the longitudinal extent of the outlet opening 40, over the latter, by means of the adjusting mechanism 25 and contacts the outer region of the nozzle body 36, in order to change the extent to which the outlet opening 40 is covered. In particular, the slide valve 26 is pushed, under the action of a spring force, against the nozzle body 36 in order to optimally seal the outlet opening 40 in its region covered in each case by the slide valve 26.

The nozzle body 36 is designed such that the longitudinal extent LS of the flow duct 38 is at least as great as the longitudinal extent LD of the nozzle slot 39. In the exemplary embodiment, the value LS is slightly greater than the value LD. The inlet opening 37 is hereby in fluid communication with the flow duct in the region of one end 41 of the flow duct 38. The other end 42 of the flow duct ends in the region of one end 43 of the nozzle slot 39. The outlet opening 40 can be covered by means of the slide valve 26, starting from the other end 44 of the nozzle slot 39. In the region of the nozzle slot 39, the flow duct 38 has a cross-sectional area which changes continuously over the local length of the flow duct 38, wherein the larger cross-sectional area faces the inlet opening 37.

The flow duct 38 and the nozzle slot 39 each have a volume which does not change.

In detail, in the region of the nozzle slot, the flow duct 38 has a cross-sectional area which changes continuously over the local length of the flow duct 38. It must not change linearly and will normally be a curve of single curvature. This cross-sectional area of the flow duct 38 decreases toward the end 42 of the flow duct. The shape of the changing cross-sectional area of the flow duct is hereby identical. The cross-sectional area of the flow duct 38 has a semi-circular shape.

Over its length, the nozzle slot 39 has a shape such that the width BD of the nozzle slot 39 between the flow duct 38 and the outlet opening 40 of the nozzle slot 39 is constant. The depth (extent in the direction Z) of the nozzle slot 39 decreases from the other end 44 to the first end 43. This depth can change along a curve of single curvature.

The outlet opening 40 and the nozzle slot 39 are arranged horizontally, and the flow duct 38 is arranged so that it is slightly inclined with respect to the horizontal.

The nozzle body 36 has two strip-like nozzle body parts 45, 46. The latter are rigidly connected to each other by means of screws 47 which pass through the nozzle body part 45 and are screwed into threaded bores 53 of the nozzle body part 46. The flow duct 38 and the nozzle slot 39 are formed between the two nozzle body parts 45 and 46. The flow duct 38 and the nozzle slot 39 are formed exclusively by depressions in the nozzle body part 45. Furthermore, the facing surfaces of the two nozzle body parts 45, 46 are designed so that they are flat such that, in the interconnected state, the nozzle body parts 45, 46 lie tight against each other in the region of these flat surfaces. A feed line to the inlet opening 37, this feed line being configured as an angled duct 48, is formed in the nozzle body part 46. The angled duct 48 opens into the flow duct 38 in the region of the end 41 of the flow duct 38 in a region remote from the outlet opening 40 of the nozzle slot 39.

The bearing surface 17 of the feed guide 18 is arranged perpendicularly to the longitudinal extent of the outlet opening 40, to the side of the outlet opening 40. On its side facing the fed guide 18, the slide valve 26 has a bearing surface 49 which in a central region is parallel to a central region of the bearing surface 17 of the feed guide 18. This respective central region is connected at the sides to insertion and exit slopes of the bearing surfaces 17 and 49. The feed guide 18 and the slide valve 26 hence serve to guide the book block 3 when it is conveyed over the nozzle body 36. The insertion of the book block 3 is facilitated by virtue of the converging insertion surfaces—bearing surfaces 17, 49.

The nozzle body part 46 is provided in the region of its remote end sides with stepped bores 50 for receiving screws 51 which can be screwed into threaded bores of a base 52 of the applicator head 19, for fastening the stationary nozzle body 36.

The specific structure of the applicator nozzle 10 in the form of a slotted nozzle is shown in FIGS. 20 to 24 for a second exemplary embodiment. Reference should be made hereby with respect to the first exemplary embodiment to the embodiments in their entirety relating to FIGS. 1 to 15. The second exemplary embodiment according to FIGS. 20 to 24 differs only in the modified geometry of the flow duct 38 and the nozzle slot 39. It can be seen in FIGS. 20 to 24 that the flow duct 38 has, in the region of the nozzle slot, a cross-sectional area which changes continuously over the local length of the flow duct 38. The change must not be linear and will normally be a curve of single curvature. This cross-sectional area of the flow duct 38 decreases toward the end 42 of the flow duct. The shape of the changing cross-sectional area of the flow duct 38 is hereby identical. The cross-sectional area of the flow duct 38 has a semi-circular shape. The cross-sectional area of the flow duct 38 at the other end 42 of the flow duct 38 is no more than half as large as the cross-sectional area of the flow duct 38 at the first end 41.

Over its length, the nozzle slot 39 has a shape such that the depth (extent in the direction Z) of the nozzle slot 39 is constant between the ends 43 and 44. The width BD of the nozzle slot 39, and hence the extent of the nozzle slot 39 in the direction X, increases from the other end 44 toward the first end 43. This width can change along a curve of single curvature. This width is, for example, 0.32 mm in the plane of section XXI-XXI, 0.35 mm in the plane of section XXII-XXII, 0.4 mm in the plane of section XXIII-XXIII, and 0.53 mm in the plane of section XXIV-XXIV, with a constant depth of the nozzle slot of 1 mm over its length.

Figure 25:
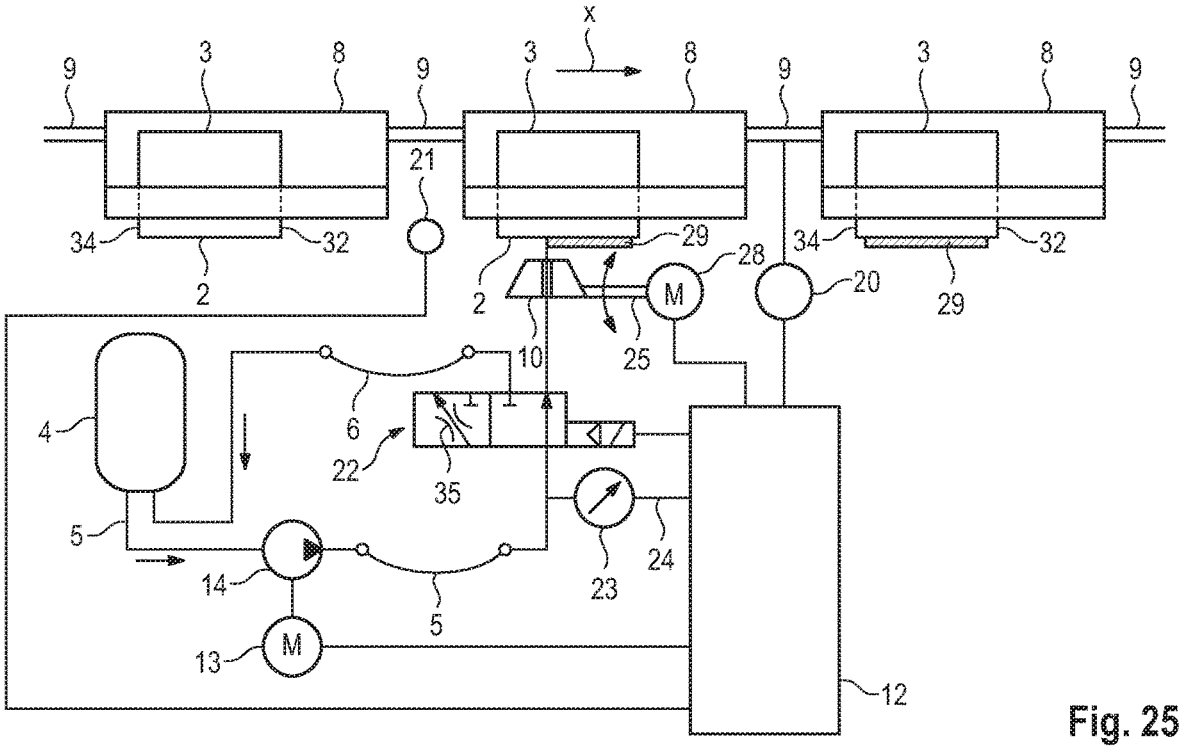
FIG. 25 shows an adhesive flow diagram for the adhesive binder.

FIG. 25 shows the basic design of the adhesive binder 1. The transport clamps 8 of the adhesive binder are fastened to the pulling means 9 and are moved in the direction X at a defined speed. This speed generally remains constant during production. The book blocks 3 are clamped in the transport clamps 8 and moved together with the transport clamps 8. The speed of the book blocks 3 is detected by the sensor 20 and forwarded to the control device 12 for processing. The book front edge associated with the front side 32 and the book rear edge associated with the rear side 34 are detected by the sensor 21 and forwarded to the control device 12 for processing. The adhesive binder transmits the signals for the book block thickness in a suitable fashion to the control device 12 such that the latter can associate the book block thicknesses to be processed explicitly with the book blocks to be processed. The important thing here is that the control device 12 has the data for the speed and the book block thickness and can determine the time at which each application of adhesive starts and finishes. The manner in which the data required for this pass to the control device 12 can also take a different form to the one which has been shown or described.

The adhesive is held ready in the pre-melter 4 in molten and flowable form. The pump 14 delivers the adhesive held ready in the pre-melter 4 via the feed line 5 and the actuator 22 or valve either to the applicator nozzle 10, during the application of adhesive to the book spines 2, or via the return line 6 back to the pre-melter 4. The pressure of the adhesive is detected by the optional pressure sensor 23 directly upstream from the actuator 22 and transmitted to the control device 12. The pressure sensor 23 is not strictly necessary for satisfactory functioning of the system and can be omitted for cost reasons or only installed temporarily.

The slide valve 26 of the applicator nozzle 10 for adjusting the application width of adhesive is activated, adjusted, and set via the adjusting mechanism 25 and the drive means 28. The signal and the triggering of the drive means 28 can either be provided or take place by the control device of the adhesive binder or by the control device 12 of the device 1. The actuator 22 for feeding the adhesive to the applicator nozzle 10 is activated by the control device 12 in such a way that the beginning of each adhesive application and the end of each adhesive application correspond precisely to the previously determined values. The actuator 22 takes the form of a switching valve. In a first position of the actuator 22, the flow from the feed line 5 to the applicator nozzle 10 is free and the return line 6 is blocked. In a second position of the actuator 22, the feed of the adhesive to the applicator nozzle 10 is interrupted and the feed line 5 is connected to the return line 6 via a choke 35 integrated into the actuator 22. Instead of this choke being integrated into actuator 22, this choke or a choke element can also be installed in the return line 6 as a separate component. When the feed of adhesive to the applicator nozzle 10 is interrupted by means of the actuator 22, if required because the thickness of the book block has changed, the slide valve 26 is displaced to match the new book block thickness.

The drive means 13 of the pump 14 is triggered with the aid of all the above described signals by the control device 12 in such a way that the application of adhesive to the book blocks 3 has a well-defined start, a well-defined end, and a uniform distribution over the length of the application. This is effected by the adhesive being delivered by means of the pump 14 working essentially in a positive displacement fashion. The theoretical volume flow of adhesive during the application is determined from the speed of the book blocks 3 being moved, from the application width, and from the application thickness of the adhesive on the book block 3. The application thickness must be fed to the control device 12 as a parameter. This is generally effected via an input terminal which is operated by the user of the device 1. As part of digital book production, the predefined value for the application thickness can also be fed to the control device 12 by the adhesive binder or from a higher-level control system. It is likewise conceivable for the signal for the book block thickness to be fed to the control device 12 from a higher-level control system. Whilst the application of adhesive to the book blocks 3 is interrupted and the actuator 22 is switched to recycle adhesive to the pre-melter 4, the pump 14 generally delivers a volume flow of adhesive which differs from the volume flow of adhesive of the applied adhesive. This volume flow of adhesive during the recycling to the pre-melter 4, i.e. during the circulation of adhesive, is of a magnitude such that the pressure of adhesive upstream from the actuator 22 is as uniform as possible, as it is during the application of adhesive to the book spines 2 via the applicator nozzle 10.

That which is claimed is:

1. A device for applying a flowable substance to at least one substrate, comprising:

an applicator nozzle comprising a stationary nozzle body having an inlet opening, a flow duct, and a nozzle slot;

wherein, with reference to an orthogonal coordinates system having a direction X, a direction Y and a direction Z, a cross-sectional area of the flow duct which extends in the direction Y is defined by a plane in the direction X and the direction Z, a width of the nozzle slot which extends in the direction Y is defined in the direction X, and a depth of the nozzle slot which extends in the direction Y is defined in the direction Z;

wherein when the flowable substance is delivered through the applicator nozzle, the flowable substance passes from the inlet opening into the flow duct and from the flow duct to the nozzle slot, and is discharged through an outlet opening of the nozzle slot;

wherein the outlet opening is arranged in an outer region of the nozzle body;

wherein the applicator nozzle further has a slide valve operable to be moved relative to the nozzle body in the direction Y to define a longitudinal extent of the outlet opening for modifying a covering of the outlet opening;

wherein a longitudinal extent of the flow duct in the direction Y is at least equal to a longitudinal extent of the nozzle slot in the direction Y;

wherein the inlet opening is in fluid communication with the flow duct in the region of a first end of the flow duct and a second end of the flow duct is in the region of a first end of the nozzle slot;

wherein the outlet opening is configured to be covered by the slide valve starting from a second end of the nozzle slot;

wherein the cross-sectional area of the flow duct decreases in the direction Y from the first end of the flow duct to the second end of the flow duct, while a volume of the flow duct defined by the cross-sectional area from the first end of the flow duct to the second end of the flow duct remains constant;

wherein the width of the nozzle slot is constant or increases over its progression in the direction Y from the second end of the nozzle slot to the first end of the nozzle slot and the depth of the nozzle slot is constant or decreases over its progression in the direction Y from the second end of the nozzle slot to the first end of the nozzle slot; and wherein the width of the nozzle slot and the depth of the nozzle slot are not both constant.

2. The device as claimed in claim 1, wherein at least one of the flow duct and the nozzle slot have an unmodifiable volume.

3. The device as claimed in claim 1, wherein an actuator for interrupting the flow of the flowable substance into the flow duct is arranged upstream from the inlet opening and is in a closed position when the slide valve is displaced.

4. The device as claimed in claim 1, wherein at least one of a change in the cross-sectional area of the flow duct over its length, a change in the width of the nozzle slot over its length, and a change in the depth of the nozzle slot over its length is non-linear.

5. The device as claimed in claim 1, wherein the cross-sectional area of the flow duct at the second end of the flow duct is no more than half as large as the cross-sectional area of the flow duct at the first end of the flow duct.

6. The device as claimed in claim 1, wherein the shape of the cross-sectional area of the flow duct is the same at the first end of the flow duct and at the second end of the flow duct.

7. The device as claimed in claim 1, wherein the nozzle body has a first nozzle body part and a second nozzle body part that are connected to each other to form the flow duct and the nozzle slot.

8. The device as claimed in claim 7, wherein at least one of the flow duct and the nozzle slot is formed exclusively by depressions in one of the first nozzle body part and the second nozzle body part.

9. The device as claimed in claim 6, wherein the cross-sectional area of the flow duct at the first end of the flow duct and at the second end of the flow duct has a semi-circular shape.

10. The device as claimed in claim 7, wherein the flow duct and the nozzle slot are formed in one of the first nozzle body part and the second nozzle body part, and wherein the inlet opening and a feed line to the inlet opening are formed in the other one of the first nozzle body part and the second nozzle body part.

11. The device as claimed in claim 1, wherein at least one of the outlet opening, the nozzle slot, and the flow duct is arranged horizontally or vertically with respect to the extent in the direction Y.

12. The device as claimed in claim 1, wherein the nozzle body is planar in the outer region and the slide valve has a planar portion for contacting the nozzle body in the outer region for sealing contact with pretensioning.

13. The device as claimed in claim 1, wherein the outlet opening is configured to be entirely covered by the slide valve.

14. The device as claimed in claim 1, further comprising a feed guide provided with a bearing surface arranged perpendicular to the longitudinal extent of the outlet opening and the slide valve has a bearing surface on a side facing the feed guide arranged parallel to the bearing surface of the feed guide, and wherein the bearing surface of the feed guide and the bearing surface of the slide valve each have surface regions which form converging insertion surfaces for the substrate.

15. The device as claimed in claim 1, further comprising a conveying device for moving the substrate over the nozzle body in the region of the outlet opening, and wherein the conveying device has an arrangement of transport clamps for clamping the substrate while the substrate is being moved.

16. The device as claimed in claim 1, wherein the flowable substance is flowable adhesive and the inlet opening, the flow duct, and the nozzle slot of the applicator nozzle are configured to deliver the flowable adhesive through the applicator nozzle.

17. The device as claimed in claim 1, wherein the flowable substance is hot melt adhesive and the inlet opening, the flow duct, and the nozzle slot of the applicator nozzle are configured to deliver the hot melt adhesive through the applicator nozzle.

* * * * *